US006802734B2

(12) United States Patent
Wu

(10) Patent No.: US 6,802,734 B2
(45) Date of Patent: Oct. 12, 2004

(54) CABLE END CONNECTOR

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/620,073

(22) Filed: Jul. 14, 2003

(65) Prior Publication Data

US 2004/0137780 A1 Jul. 15, 2004

Related U.S. Application Data

(63) Continuation-in-part of application No. 10/600,517, filed on Jun. 19, 2003, which is a continuation-in-part of application No. 10/377,853, filed on Feb. 28, 2003, now Pat. No. 6,743,050, which is a continuation-in-part of application No. 10/317,830, filed on Dec. 11, 2002, now Pat. No. 6,699,073.

(51) Int. Cl.[7] ..... H01R 13/627
(52) U.S. Cl. ..... 439/362; 439/76.1
(58) Field of Search ..... 439/362–365, 439/650–655, 638, 359, 573, 76.1

(56) References Cited

U.S. PATENT DOCUMENTS 5,123,859 A * 6/1992 Davis et al. ..... 439/405
5,158,474 A * 10/1992 Frantz ..... 439/362
5,271,689 A * 12/1993 Ishii et al. ..... 403/408.1
5,306,175 A * 4/1994 Swanstrom ..... 439/362
5,342,216 A * 8/1994 Davis et al. ..... 439/362
5,348,494 A * 9/1994 Falossi et al. ..... 439/362
5,383,795 A * 1/1995 Falossi et al. ..... 439/362
5,871,373 A * 2/1999 Pacini et al. ..... 439/587
5,904,441 A * 5/1999 Kodama et al. ..... 403/337
5,920,459 A * 7/1999 Weber et al. ..... 361/752
5,971,791 A * 10/1999 Itoh et al. ..... 439/364
5,989,051 A * 11/1999 Zelno et al. ..... 439/362
6,116,942 A * 9/2000 Chen et al. ..... 439/362
6,176,743 B1 * 1/2001 Kuo ..... 439/638
6,296,534 B1 * 10/2001 Yi ..... 439/876
6,319,066 B2 * 11/2001 Kuo ..... 439/638
6,343,957 B1 * 2/2002 Kuo et al. ..... 439/638
6,520,791 B2 * 2/2003 Burger ..... 439/362
6,530,801 B2 * 3/2003 Bates et al. ..... 439/364

* cited by examiner

*Primary Examiner*—Ross Gushi
(74) *Attorney, Agent, or Firm*—Wei Te Chung

(57) ABSTRACT

An electrical connector (1) includes a front housing portion (10), a rear housing portion (12) engageable with the front housing portion, a contact module (14) sandwiched between the front and rear housing portions and four screws (16) retained by the front and rear housing portions. The front housing portion provides four projection (28) at respective corners thereof and the rear housing portion provides four ear portions (46) at respective corners thereof in accordance with corresponding projections. The projections and the ear portions may cooperatively retain respective screws therein and the screws may be released from the projections and the ear portions when the rear housing portion is disengaged from the front housing.

12 Claims, 6 Drawing Sheets

CABLE END CONNECTOR

CROSS-REFERENCE TO RELATED APPLICATIONS

This application is a continuation-in-part (CIP) of U.S. patent application Ser. No. 10/317,830, titled by CABLE ASSEMBLY, filed on Dec. 11, 2002, now U.S. Pat. No. 6,699,073; and U.S. patent application Ser. No. 10/377,853, titled by CABLE ASSEMBLY WITH LATCH MECHANISM, filed on Feb. 28, 2003, now U.S. Pat. No. 6,743,050; and U.S. patent application Ser. No. 10/600,517, titled by CABLE ASSEMBLY WITH IMPROVED GROUNDING MEANS, filed on Jun. 19, 2003, all are made by the same inventor and assigned to the same assignee. The disclosure of the above identified applications is incorporated herein by reference.

BACKGROUND OF THE INVENTION

1. Field of the Invention

The present invention is related to a cable end connector, and especially to a cable end connector having removable screws for securing the cable end connector to a complementary connector.

2. Description of the Related Art

With the development of communication and computer technology, high density electrical connectors, for example male and female connectors, are desired to construct a large number of signal transmitting paths between two electronic devices where the male and female connectors are mounted. Latch or screw means are required to keep the male and female connectors mated to resist vibration which may disengage the male connector from the female connector.

U.S. Pat. No. 5,387,123 discloses an electrical connector having a pair of moveable latches at opposite sides thereof. Each latch has an elastic means which, when not be pressed, can drive the latch end to engage with a corresponding member of the complementary connector. However, the latch means is not reliable in bad vibration circumstance. U.S. Pat. No. 5,725,387 discloses a cable end connector having a pair of screws at opposite sides thereof. The screws have threaded heads that are operable to engage with corresponding elements of a complementary connector after the cable end connector mates with the complementary connector. The screws have good performance of resisting vibration. However, as disclosed in the 5,725,387 patent, the screws are molded in a cover, so when the screws become worn, they cannot be replaced by new ones without destroying the cover, therefore, the cable end connector become useless.

Therefore, an improved cable end connector is desired to overcome the above disadvantages.

SUMMARY OF THE INVENTION

An object of the present invention is to provide a cable end connector having removable screws for securely joining the cable end connector with a complementary connector.

To obtain the above objects, an electrical connector includes a front housing portion, a rear housing portion engageable with the front housing portion, a contact module sandwiched between the front and rear housing portions and four screws retained by the front and rear housing portions. The front housing portion provides four projections at respective corners thereof and the rear housing portion provides four ear portions at respective corners thereof in accordance with the corresponding projections. Each projection defines a through-hole therethrough and each ear portion defines a U-shaped cutout. Each screw includes a threaded head, an operation end at opposite ends thereof and a pole between the threaded head and the operation end. A ring is formed at a middle section of the pole. The screw is movably received in the through-hole and the cutout when the front housing portion engages with the rear housing portion. The through-hole includes a first segment and a second segment with a shoulder being formed at the conjunction of the first and second segments. The ring has a dimension larger than that of the first segment and the cutout but smaller than the second segment such that the ring is movable between the shoulder and the ear portion. Since the front housing is disengageable from the rear housing portion by simply release the latches of the rear housing portion from the front housing portion, it is very convenient to disassemble the screws from the front and rear housing portions.

Other objects, advantages and novel features of the invention will become more apparent from the following detailed description of the present embodiment when taken in conjunction with the accompanying drawings.

DESCRIPTION OF THE PREFERRED EMBODIMENT

Figure 1:
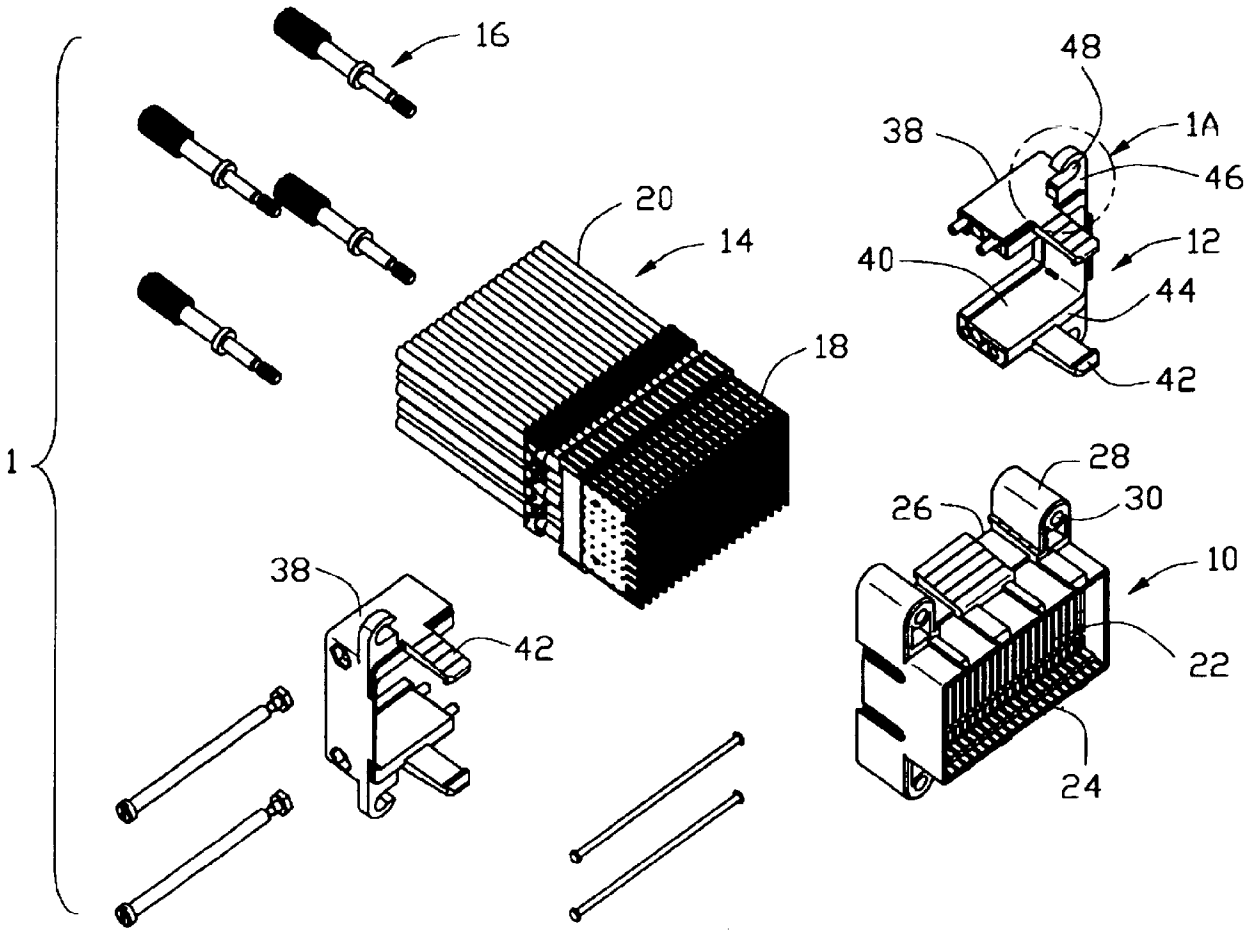
FIG. 1 is an exploded perspective view of an electrical connector of the present invention.

Referring to FIG. 1, an electrical connector 1 of the present invention includes a first or front housing portion 10, a second or rear housing portion 12 attachable to the front housing portion, a contact module 14 retained between the front and rear housing portions and screws 16 attachable to the front and rear housing portions for securing the electrical connector 1 to a complementary connector (not shown). The electrical connector 1 is somewhat disclosed in the U.S. patent application Ser. No. 10/317,830, titled by CABLE ASSEMBLY, filed on Dec. 11, 2002; and the U.S. patent application Ser. No. 10/377,853, titled by CABLE ASSEMBLY WITH LATCH MECHANISM, filed on Feb. 28, 2003; and the U.S. patent application Ser. No. 10/600,517, titled by CABLE ASSEMBLY WITH IMPROVED GROUNDING MEANS, filed on Jun. 19, 2003, all are made by the same inventor and assigned to the same assignee, which are incorporated herein by reference (these applications will be indicated by prior U.S. patent applications hereinafter).

The contact module 14 includes a number of sub-PCBs 18 arranged side-by-side and a number of cables 20 with conductive cores connecting with conductive traces on the sub-PCBs 18 (not shown). The contact module 14 is disclosed in the prior U.S. patent applications and will not be described here in detail for concision.

Figure 4:
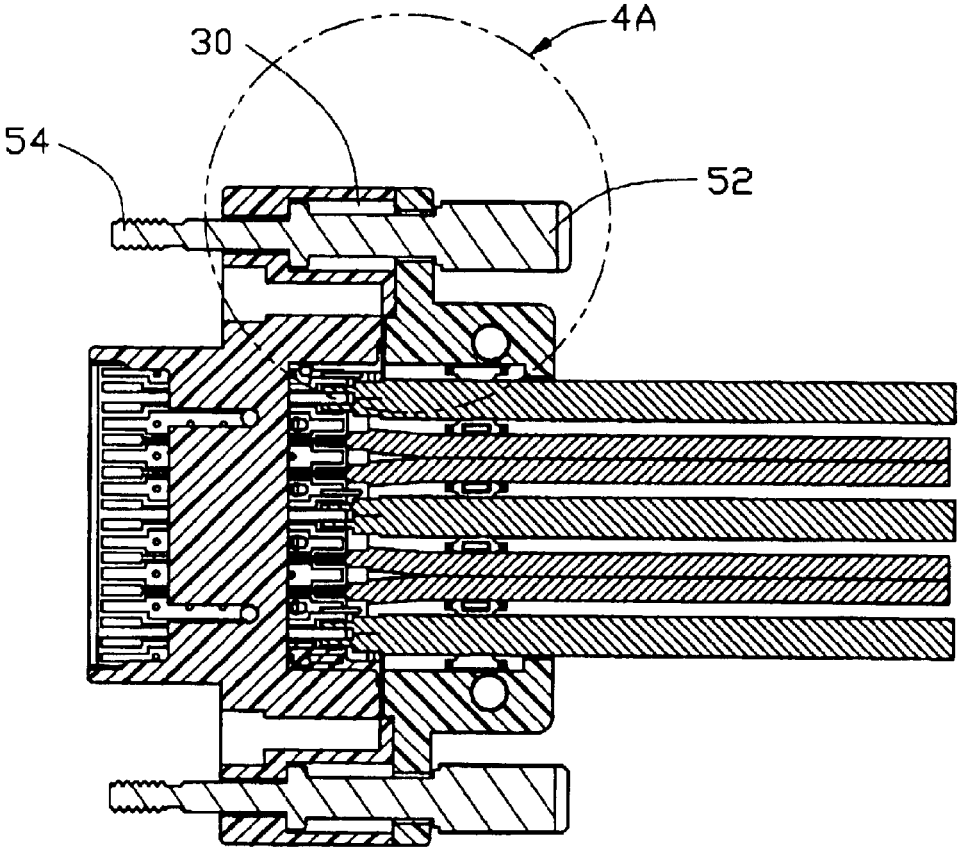
FIG. 4 is a cross-sectional view of the electrical connector taking along line 4—4 in FIG. 3.
Figure 4A:
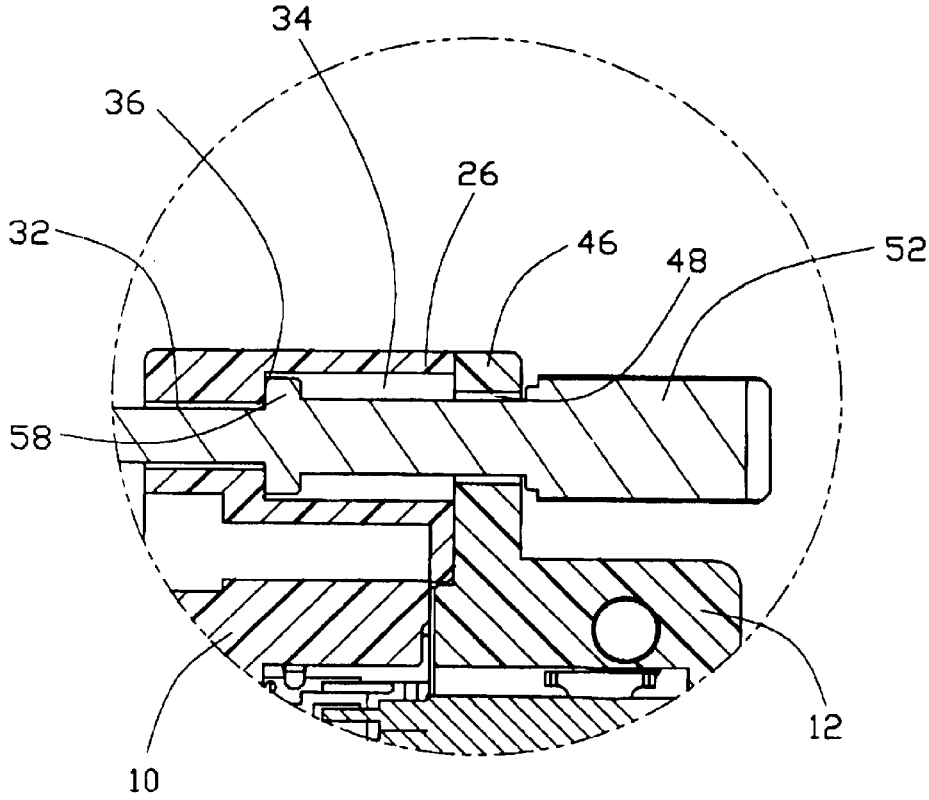
FIG. 4A is an enlarged view of a circled part that is labeled by 4A in FIG. 4.

The front housing portion 10 defines a number of parallel passageways 22 through front and rear ends 24, 26 thereof for partially receiving the respective sub-PCBs 18. There are four projections or stations 28 on upper and lower surfaces of the front housing portion 10 and each projection is generally located at a particular one of the corners of the front housing portion 10. As shown in FIGS. 4 and 4A, each projection 28 defines a through-hole 30 extending generally parallel with the passageway 22. The through-hole 30 includes a first segment 32 and a second segment 34 along the extending direction thereof, wherein the second segment 34 is closer to the rear end 26 of the first housing portion 10 than the first segment 32. The second segment 34 is of a larger size than the first segment 32 such that a shoulder 36 is formed at the conjunction of the first and second segments 34, 36. As a result, the screw 16 can only be inserted into and withdrew from the through-hole 30 from the rear end 26.

Figure 1A:
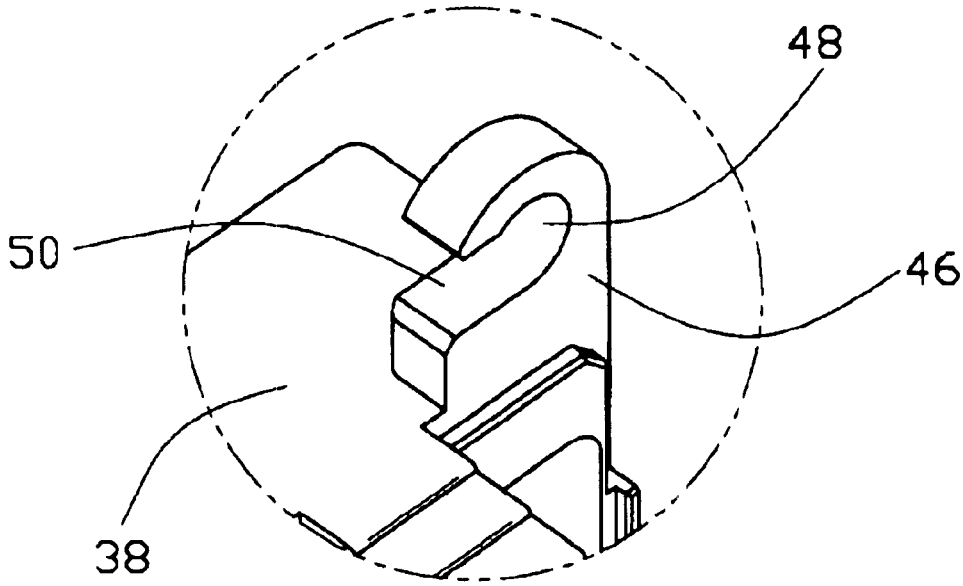
FIG. 1A is an enlarged view of a circled part that is labeled by 1A in FIG. 1.

The rear housing portion 12 includes a pair of frames 38 and defines a window 40 therethrough after the frames 38 engage with each other. Four latches 42 forwardly extend from a front edge 44 of the rear housing 12 for attaching the rear housing portion 12 to the front housing portion 10. The rear housing portion 12 forms four ear portions 46 on top and bottom surfaces thereof. The ear portions 46 are particularly located at respective corners of the rear housing portion 12. Referring to FIG. 1A, each ear portion 46 defines a generally U-shaped cutout or aperture 48 that has an exit 50 at one side thereof for entrance of the screw 16.

Figure 2:
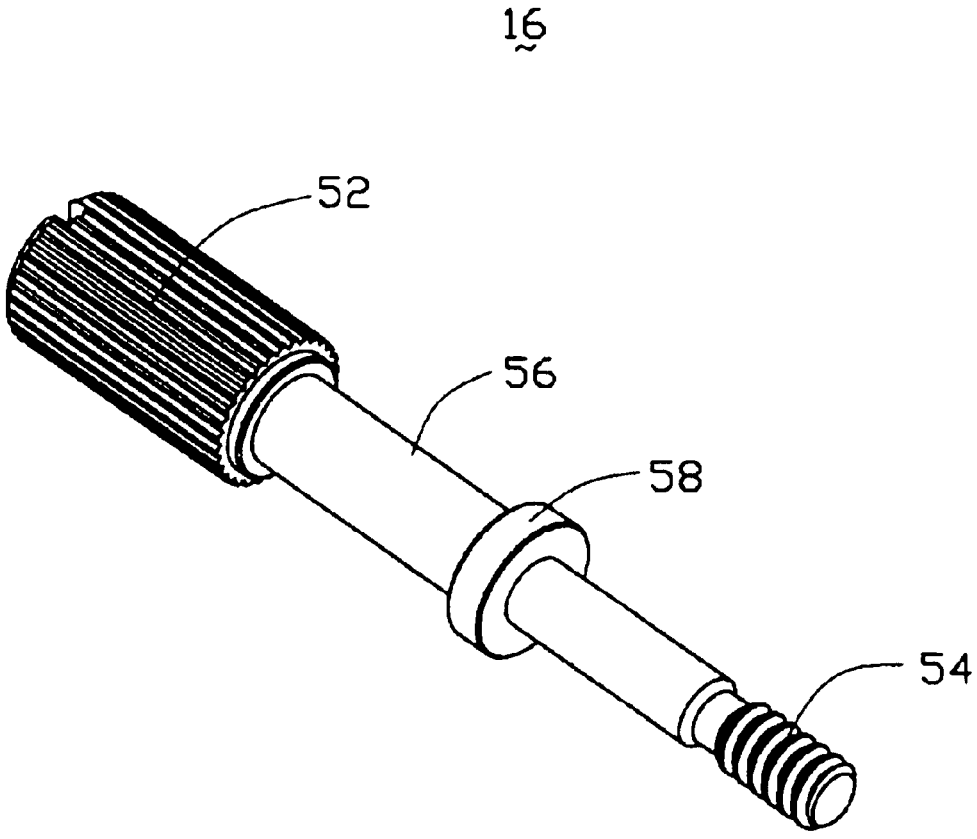
FIG. 2 is an enlarged perspective view of a screw in FIG. 1.
Figure 3:
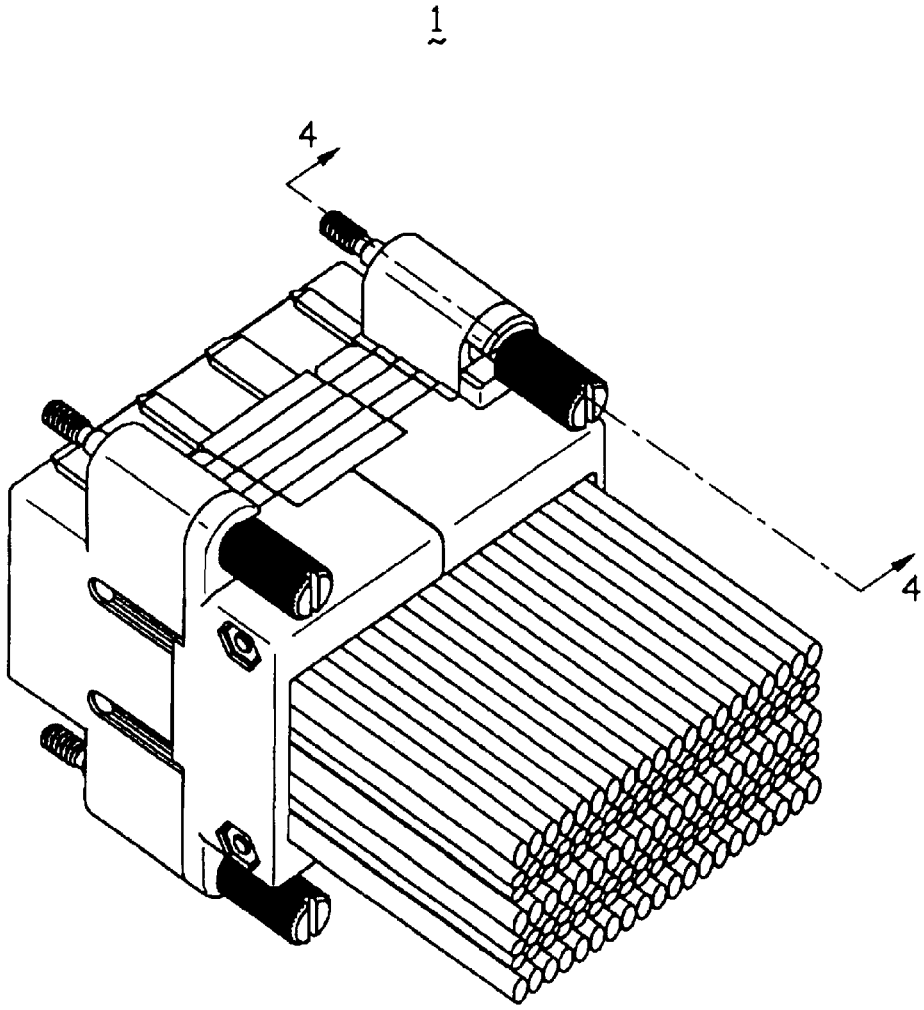
FIG. 3 is an assembled rear perspective view of the electrical connector in FIG. 1.

Referring to FIG. 2, each screw 16 includes an operation end 52 at a rear end thereof, a threaded head 54 at a front end thereof, a pole 56 between the operation end 52 and the threaded head 54, and a ring 58 generally at a middle section of the pole 56. The operation end 52 forms keys on an outer surface thereof for facilitating operating the screw 16. The ring 58 has a larger diameter than the pole 56.

Referring to FIGS. 1, 4 and 4A, in assembly, the frames 38 are attached to each other to sandwich the contact module 14 therebetween with the cables 20 exiting from the window 40. Each screw 16 is laterally attached to a respective ear portion 46 via the exit 50 with the operation portion 52 and the ring 58 located at opposite sides of the respective ear portion 46. The contact module 14 together with the rear housing portion 12 and the screws 16 are assembled to the front housing portion 10 with the latches 42 engaging with the front housing portion 10. As particularly illustrated in FIGS. 4 and 4A, the threaded head 54 is forward inserted through the through-hole 30, the operation end 52 is located behind the ear portion 46 while the ring 58 is moveably received in the second segment 34 of the through-hole 30. The ring 58 is limited to be moveable between the shoulder 36 and the ear portion 46 because the dimension of the ring 58 is smaller that that of the second segment 34 but larger than that of the first segment 32 and that of the U-shaped cutout 48.

The electrical connector 1 of the present invention has several advantages over the prior art. First, since the housing includes several parts that are engageable with each other, the assembly of the contact module 14 to the housing becomes much easy. Second, the screws 16 may be disassembled from the projections 28 and the ear portions 46 by simply disengaging the latches 42 from the front housing portion 10 which will not destroy the housing. Third, the projections 28 are located on out surface of the front housing portion 10, so the screws 16 will not disturb the arrangement of contact module.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

first housing portion defining a passageway extending between a rear end and a front end thereof and a through-hole extending generally parallel with the passageway, the through-hole including a first segment and a second segment along the extending direction thereof, the second segment being closer to the rear end of the first housing portion than the first segment;

a second housing portion assembled at the rear end of the first housing portion, the second housing portion defining a cutout in alignment with the through-hole of the first housing portion;

a contact module retained by the first and second housing portions and having at least a portion received in the passageway of the first housing portion; and a screw supported by the first and second housing portions and being moveable along and in the through-hole of the first housing portion, the screw including a ring received in the second segment of the through-hole of the first housing portion and a threaded head and an operation end out of the first and second housing portions, the ring being dimensioned larger than the first segment of the through-hole of the first housing portion and the cutout of the second housing portion but smaller than the second segment of the through-hole of the first housing portion.

2. The electrical connector as recited in claim 1, wherein the through-hole is stepped and a shoulder is formed at the conjunction of the first and second segments of the through-hole.

3. The electrical connector as recited in claim 1, wherein the first housing portion has a projection at an outer frame thereof, and wherein the through-hole is defined in the projection.

4. The electrical connector as recited in claim 3, wherein the second housing portion has an ear portion in alignment with the projection of the first housing portion, the cutout being defined in the ear portion.

5. The electrical connector as recited in claim 1 wherein the contact module includes a plurality of sub-PCBs and cables attached to respective sub-PCBs.

6. The electrical connector as recited in claim 5, wherein the second housing portion defines a window in alignment with the passageway of the first housing portion, the cables extending out of the second housing portion through the window.

7. The electrical connector as recited in claim 1, wherein the second housing portion has latches extending to engage with the first housing portion.

8. The electrical connector as recited in claim 1, wherein the second housing portion includes a pair of U-shaped frames joined together.

9. An electrical connector comprising:

a housing portion defining a rectangular cross-sectional configuration with two opposite longer longitudinal sides along a longitudinal direction and two opposite shorter lateral sides along a lateral direction along said longitudinal direction;

two pairs of projection stations with through holes therein, being provided on two opposite ends of said two opposite longitudinal sides, respectively;

a plurality of juxtaposed printed circuit boards located in the housing portion;

a plurality of cables secured to rear portions of said printed circuit boards; and two pairs of screws extending through said through holes, respectively; wherein said two pairs of screws are located by two sides of said cables along said lateral direction.

10. An electrical connector comprising:

a first insulative housing defining a pair of projection stations at two opposite ends thereof along a first direction;

a pair of through holes defined in the corresponding projection stations, respectively;

a second insulative housing attached to a rear face of the first housing;

a pair of opposite apertures defined in the second housing and in alignment with the corresponding through holes, respectively, along a second direction perpendicular to said first direction; and a pair of screws extending through said pair of apertures and said pair of through holes along said second direction, respectively; wherein said first housing and said second housing include an interengagement device to secure both said first housing and said second housing together along said second direction, and said interengagement device is protectively located between said pair of projection stations along said first direction.

11. The electrical connector as recited in claim 10, wherein said interengagement device is protectively located below said pair of projection stations along a third direction perpendicular to both said first and second directions.

12. An electrical connector comprising:

a front insulative housing;

a rear insulative housing attached to a rear portion of the front insulative housing;

a plurality of contact modules located in said front and rear housings;

a plurality of cables secured to and rearwardly extending from rear portions of said contact modules;

at least one pair of projection stations provided on the front housing with through holes therein;

at least one pair of ear portions provided on the rear housing with apertures therein in alignment with the corresponding through holes, respectively, along a front-to-back direction;

a pair of screws extending through said through holes with ring structures thereon, respectively; wherein said ring structure is axially movable in said through hole with forward restriction by said front housing and rearward restriction by said rear housing.

* * * * *